United States Patent [19]

Johansson et al.

[11] 4,355,767

[45] Oct. 26, 1982

[54] DEVICE IN GRINDING APPARATUS

[75] Inventors: Inge J. G. Johansson, Taby, Sweden; Rolf B. Reinhall, Bellevue, Wash.

[73] Assignee: Defibrator Aktiebolag, Stockholm, Sweden

[21] Appl. No.: 826,537

[22] Filed: Aug. 22, 1977

[30] Foreign Application Priority Data

Sep. 10, 1976 [SE] Sweden ..... 76100627

[51] Int. Cl.[3] ..... B02C 7/12

[52] U.S. Cl. ..... 241/244; 51/169; 74/573 F; 241/292

[58] Field of Search ..... 241/244, 260, 261.2, 241/261.3, 292; 51/169; 74/573 F

[56] References Cited

U.S. PATENT DOCUMENTS

| | | | |
|---|---|---|---|
| 197,023 | 11/1877 | Ent | 241/292 |
| 1,563,216 | 11/1925 | Moog . | |
| 1,995,549 | 3/1935 | Myers . | |
| 2,156,320 | 5/1939 | Sutherland, Jr. | 241/244 X |
| 2,525,781 | 10/1950 | Renier | 74/573 F X |
| 3,170,647 | 2/1965 | Fisher | 241/292 |
| 3,170,649 | 2/1965 | Fisher | 241/292 |
| 3,950,897 | 4/1976 | Birkenstack et al. | 51/169 |
| 3,982,704 | 9/1976 | Palyl | 241/260 X |

FOREIGN PATENT DOCUMENTS

| | | | |
|---|---|---|---|
| 18716 | of 1902 | United Kingdom | 241/292 |

*Primary Examiner*—Howard N. Goldberg
*Attorney, Agent, or Firm*—Eric Y. Munson

[57] ABSTRACT

A grinding apparatus in which lignocellulose-containing material such as wood chips is ground in a grinding space defined between cooperating disc segments carried by a rotating disc and a stationary disc in close spacing tolerance. In order to counteract the deflective centrifugal force exerted on the rotating disc segments, the peripheral portion at the rear of the rotating disc is formed with an annular bulge having an annular channel therein for receiving mercury in an amount calculated to generate during the rotation of the bulging disc a counter centrifugal force equal to the deflecting centrifugal force exerted on the rotating grinding segments to thereby maintain the close tolerance spacing between the cooperating grinding segments.

1 Claim, 1 Drawing Figure

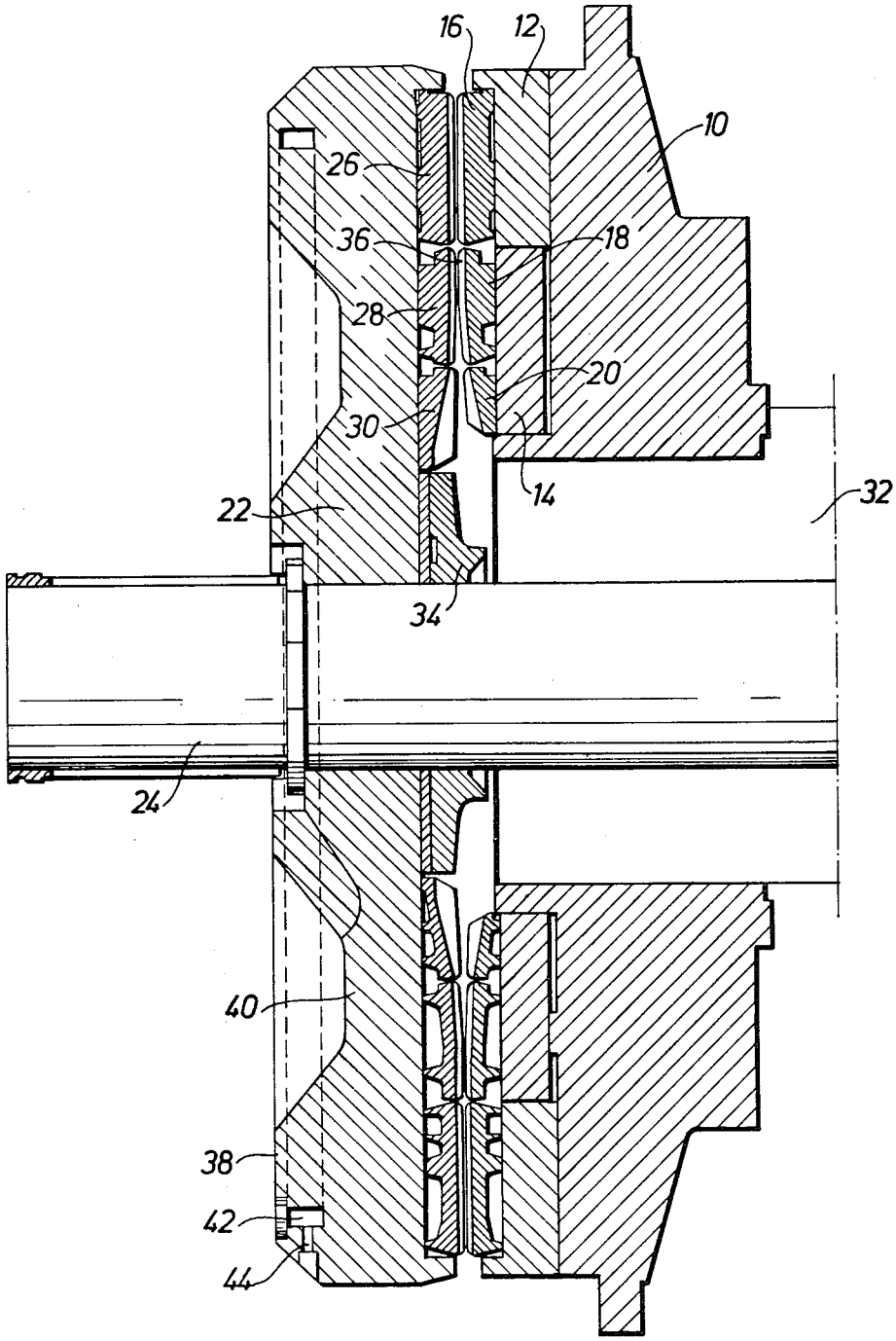
16
12
10
26
36
18
28
20
30
14
32
22
34
24
40
38
42
44

DEVICE IN GRINDING APPARATUS

BACKGROUND OF THE INVENTION

The present invention relates to a device in grinding apparatus with grinding discs rotatable relatively to one another between the grinding surfaces of which facing one another the material to be ground is disintegrated, the rotatable grinding disc or discs carrying concentric rows of grinding segments forming the rotating grinding surface. The grinding apparatus is primarily intended for disintegration of the material such as wood in the shape of chips or other lignocellulose containing material. To attain the intended degree of grinding, viz. uncovering of the fibres and/or fibrils, the grinding gap between the grinding discs must have a very narrow width such as a millimeter or a few tenths of a millimeter and even less. In modern embodiments the grinding discs have a diameter of e.g. 1400 mms and the grinding pressure which usually is produced by means of one or several hydraulic servomotors acting on the rotatable grinding disc may be of the order of magnitude of 50 tons. The number of revolutions is usually 1500 to 1800 per minute. This results in the rotatable grinding disc during operation being subjected to a strong bending moment by the effect of the centrifugal force on the grinding segments which causes the grinding gap to increase in width in radial outward direction to such a degree that the grinding effect is impaired. In an attempt to compensate for this deflection, the grinding surface has been given a conical profile so that after the deflection it becomes nearly parallel with the facing grinding surface. Due to the high r.p.m. of the large grinding disc, axially directed forces can thus be generated by the centrifugal force which totally compensate for prevent deflection and thus the deformation of the grinding surface which results from the unbalance caused by the grinding segments. The grinding pressure between the grinding discs also causes some deflection of the rotating grinding disc which deflection although considerably less than that resulting from the rotation, can also be eliminated by the bulkier outer portion of the disc. Thus, according to the invention the grinding surface of the rotating disc from its beginning can be made parallel with that of the other grinding disc.

According to an especially suitable embodiment of the invention, the axially projecting portion extending about the circumference of the disc is provided with a channel adapted to contain a varying quantity of mercury. In this way a fine adjustment can be achieved of the axial component generated by the annular outer portion of the rotating grinding disc so that the parallelism between the grinding surfaces is precisely maintained. The invention also makes it possible to compensate for the weight which the grinding segments losses by the wearing away of material during the grinding operation.

SUMMARY OF THE INVENTION

The invention solves the problem of deflection by providing the rotating disc with a peripheral annular bulging portion which extends in an axial direction away from the grinding surface. The weight of the annular portion and its location on the back of the rotating disc are calculated so as to generate a counteracting force substantially equal to the deflective centrifugal force exerted on the grinding segments.

BRIEF DESCRIPTION OF THE DRAWING

The invention will be described nearer hereinafter with reference to an embodiment of the invention illustrated in axial section on the attached drawing.

DESCRIPTION OF A PREFERRED EMBODIMENT

In the drawing, 10 denotes a portion of the stationary casing in a grinding apparatus which casing carries a stationary grinding disc. The casing comprises two concentrically disposed retainer rings 12, 14 which carry disc segments 16, 18, 20 forming the stationary grinding surface provided with conventional grooves or ridges with radial and peripheral extensions.

A rotatable grinding disc 22 is fixed on a shaft 24, which is supported in bearings not shown of the stationary casing, and is provided with concentrically disposed disc elements 26, 28, 30, in the same manner as the stationary disc each element being subdivided into segments, which elements form the rotating grinding surface having conventional grooves and/or ridges. The segments are replaceably secured to their discs by means of screw connections. The material to be ground, such as wood chips, is introduced through a central channel 32 into the stationary casing 10 and is thrown by an interior driver disc 34 connected with the rotating disc 22 outwards towards the grinding gap 36 between the two grinding discs. The material to be ground thereafter passes between the various grinding disc elements whereunder, it is subjected to a grinding operation so that the individual fibres and/or the fibrils thereof are uncovered. The grinding pressure is produced in known manner by means of one or several hydraulic servomotors (not shown), the movable part or piston of which acts on the shaft 24.

To obtain the desired disintegration of the starting material it is essential that the parallelism between the grinding surfaces is maintained especially in the outer zone of the grinding gap 36 which is formed by the disc segments 16 and 26. According to the invention, the rotating grinding disc in its radially outer zone which is located approximately straight opposite the ring segments 26 is on its outside formed with a peripheral bulge or enlarged portion 38 which inwardly is confined by a constriction or recess 40 in the grinding disc. During rotation at high speed of the disc 22, the axially projecting portion 38 generates a torque on the disc which is equal to the torque exerted in the opposite direction on the segments by the centrifugal force. Thus, the rotating disc retains its original form. The torque from the portion 38 corresponds to the product of the centrifugal force acting on the portion 38 and an arm corresponding to the distance between the centre of gravity of that portion and the centre line of the disc. In this connection the torque is adjusted so that it can counterbalance the torque which is produced by the grinding pressure and which tends to bend the grinding disc in opposite direction.

It is especially suitable to form in the enlarged portion 38 an annular channel 42 which by a sealable opening 44 can be filled in varying quantity with mercury which has a higher specific weight than the grinding disc otherwise substantially consists of iron. This makes it possible to vary the torque on the disc 22 produced by the centrifugal force and thereby bring about a precise adjustment of the parallelism between the grinding surfaces particularly in the outer zone which is formed by the segments 16, 26. It is easily understood that the mercury during rotation turns up as a uniform ring about the circumference.

What is claimed is:

1. In a grinding apparatus in which lignocellulose-containing material is ground in a grinding space defined between a stationary disc and a rotating disc, the rotating disc on one face thereof having a plurality of grinding segments to be maintaind in close tolerance spacing relative to cooperating grinding segments on the stationary disc, and on the opposite face an annular bulging peripheral portion for counteracting the deflective centrifugal force on the rotating disc segments, the improvement comprising an annular channel in said bulging portion for receiving mercury in an amount calculated to generate during the rotation of the disc having the bulging peripheral portion a counter centrifugal force equal to the deflecting centrifugal force exerted on the rotating grinding segments to thereby maintain the close tolerance spacing between the cooperating grinding segments.

* * * * *